US007648322B2

(12) United States Patent
Moncrief et al.

(10) Patent No.: US 7,648,322 B2
(45) Date of Patent: Jan. 19, 2010

(54) AUTOMATIC CARTON MAGAZINE LOADING SYSTEM

(75) Inventors: Frank N. Moncrief, Acworth, GA (US); Timothy W. Hendricks, Acworth, GA (US); Jeff Disrud, Acworth, GA (US)

(73) Assignee: Graphic Packaging International, Inc., Marietta, GA (US)

( * ) Notice: Subject to any disclaimer, the term of this patent is extended or adjusted under 35 U.S.C. 154(b) by 373 days.

(21) Appl. No.: 11/318,847

(22) Filed: Dec. 27, 2005

(65) Prior Publication Data

US 2007/0147981 A1 Jun. 28, 2007

(51) Int. Cl.
*B65B 21/02* (2006.01)
*B65G 57/00* (2006.01)
*H01L 21/68* (2006.01)

(52) U.S. Cl. ..... 414/419; 414/790.2; 414/789.2; 414/795.2; 414/783; 414/789.6; 294/65

(58) Field of Classification Search ..... 414/741, 414/790.2, 763, 765, 773, 776, 783, 796.4, 414/403, 419, 412, 796.9, 797.8, 659, 271, 414/281, 279, 796.3; 901/8, 46–47; 53/493, 53/540; 271/145, 186; 700/218
See application file for complete search history.

(56) References Cited

U.S. PATENT DOCUMENTS

| | | | | |
|---|---|---|---|---|
| 3,343,690 | A * | 9/1967 | Dean | 414/790.2 |
| 4,367,997 | A | 1/1983 | Schweingruber | |
| 4,498,381 | A * | 2/1985 | Convey, Jr. | 100/100 |
| 4,502,587 | A | 3/1985 | Clark | |
| 4,573,863 | A * | 3/1986 | Picotte | 414/763 |
| 4,667,808 | A | 5/1987 | Mastak | |
| 4,854,817 | A | 8/1989 | Dorner | |
| 5,024,577 | A * | 6/1991 | Miura | 414/788.4 |
| 5,039,081 | A * | 8/1991 | Shill | 271/151 |
| 5,042,862 | A * | 8/1991 | Tubke | 294/86.4 |
| 5,391,050 | A * | 2/1995 | Gatteschi | 414/796 |
| 5,970,834 | A * | 10/1999 | Garofano et al. | 83/90 |
| 6,290,452 | B1 * | 9/2001 | Wachter | 414/788.1 |
| 6,595,740 | B1 | 7/2003 | Drake et al. | |
| 6,695,570 | B2 | 2/2004 | Ford et al. | |
| 6,719,519 | B2 * | 4/2004 | Liehs | 414/419 |
| 6,952,911 | B2 | 10/2005 | Byrd, Jr. et al. | |
| 7,073,310 | B1 | 7/2006 | Long et al. | |
| 2003/0103838 | A1 | 6/2003 | Liehs | |

FOREIGN PATENT DOCUMENTS

| | | |
|---|---|---|
| EP | 0 854 088 A1 | 7/1998 |
| EP | 1 380 392 A2 | 1/2004 |

* cited by examiner

*Primary Examiner*—Gregory W Adams
(74) *Attorney, Agent, or Firm*—Womble Carlyle Sandridge & Rice, PLLC

(57) ABSTRACT

A magazine loader for automatically loading stacks of cartons onto a magazine of a mass feeder for supplying cartons to a packaging machine, includes a loader in which stacks of cartons are received and held, and a carriage on which the loader is pivotally mounted. The cartons are received loaded in the loader, after which the loader is pivoted from a loading position to a stacking position. The loader is then moved along a feeder conveyor for the packaging machine toward a magazine or supply of previously stacked cartons, until the stack of cartons is received and stacked against the previously loaded cartons to maintain a supply of cartons for feeding into the packaging machine.

12 Claims, 6 Drawing Sheets

AUTOMATIC CARTON MAGAZINE LOADING SYSTEM

FIELD OF THE INVENTION

The present invention generally relates to packaging machinery or equipment, and in particular, the present invention relates to a system for receiving stacks of cartons and automatically loading the stacks of cartons into a position for feeding into a packaging machine for wrapping products with the cartons.

BACKGROUND OF THE INVENTION

Typically, in the product packaging industry such as in the beverage bottling field, a series of products are passed through a packaging machine wherein groups of products are segmented and wrapped with paperboard cartons. For example, a series of beverage cans can be passed through the packaging machine and wrapped with paperboard cartons in six, eight, or twelve pack configurations. The wrapped products generally then are conveyed further downstream to packaging and palletizing for shipping. Typically, the cartons are preprinted paperboard strips or wraps, generally formed with locking tabs or recesses, and are fed into the packaging machine from a magazine or feeder. The cartons are fed individually from the feeder in time with the movement of the products through the packaging machine, so that as the products are segmented into groups, such as six packs, twelve packs, etc., each group is moved in time with a carton that is then placed over and locked about the products.

In the past, the cartons generally have been manually loaded in stacks on the magazine or feeder for loading into the packaging machine. This typically requires an operator to be present to manually pickup and load stacks of cartons from pallets or other storage means onto the mass feeder for the packaging machine. The machine operator thus generally must continually monitor the level or amount of cartons stacked for loading into the packaging machine so that the stack of cartons waiting to be fed into the packaging machine can be kept relatively constant to ensure the packaging machine will not run out of its supply of cartons during operation. Such a task does not, however, tend to occupy the operator's time completely, and thus simply having an operator stand by the magazine or feeder and periodically load new stacks of cartons onto the magazine or feeder for feeding into the packaging machine constitutes an inefficient use of the operator's time.

Typically, therefore, the operator will be charged with other tasks that they can perform while they periodically check the magazine or feeder to load additional stacks of cartons onto the magazine or feeder as needed. If, however, the operator fails to keep up with the supply of cartons on the magazine or feeder for the packaging machine, the supply of cartons could run out, thus requiring the packaging machine to be shut down and reprimed, resulting in a costly downtime and lost production. In addition, many of the operations in a packaging facility are now highly automated, including the packaging of the products within their carton wraps, as well as the depalletizing and transport of the cartons to the packaging machine. It is accordingly desirable to try to further reduce the amount of manual operations required for the operation of the packaging line to the fullest extent possible, to increase efficiency and lower costs, and to try to reduce risks of workplace injuries such as repetitive strain injuries.

It can be seen that a need therefore exists for a carton loading system for automatically loading cartons onto a mass feeder for a packaging machine that solves the above discussed and other related and unrelated problems in the art.

SUMMARY OF THE INVENTION

Briefly described, the present invention generally is directed to an automatic carton magazine loading system for loading stacks of cartons on a magazine or mass feeder for a packaging machine for maintaining a supply of cartons for feeding to the packaging machine for continued operation thereof. The loading system of the present invention generally includes a removable support frame that typically includes an upstanding beam or stanchion mounted to a carriage or drive plate. The carriage rides along a guide track or conveyor that extends along a feeder conveyor for the mass feeder or magazine of the packaging machine on which the stacks of cartons are to be loaded.

A loading conveyor further generally is mounted adjacent the frame and includes an upstream end and a downstream or discharge end. The loading conveyor can include belts, chains or other conveying elements and will convey and transfer the stacks of cartons to a loader that is mounted to the frame of the loading station or system, which stacks of cartons will then be transferred by the loader to the feeder conveyor. The loader generally is at least initially positioned at the downstream or discharge end of the loading conveyor and is moveably mounted on and carried by the support frame as the support frame is moved along a discharge path along the feeder conveyor.

The loader generally includes a loader frame having a base support or plate on which the cartons are received in a substantially flat, vertically stacked attitude, with a pair of arms or support members projecting at an approximately 90° angle upwardly from the base support. Alternatively, the loader frame can be formed from a pair of parallel, substantially L-shaped plates, each having a rear portion, a flat, longitudinally extending support portion, and with each further having an arm or support member mounted to and/or projecting at an approximately 90° angle from a distal end of the support portion of each plate. A clamp mechanism further generally is provided adjacent a rear portion of the base of the loader and generally will include a clamp plate that is moveable into engagement with a stack of cartons received on the loader so as to urge the stack of cartons against the arms or support members. The clamp plate can be substantially rectangularly shaped, forked, substantially U-shaped, or other desired configuration and generally will be attached to a drive mechanism such as a cylinder, motor, travel screw, or other similar mechanism. The drive mechanism moves the clamp plate toward and away from the support members or arms of the loader to engage and hold or clamp a stack of cartons therebetween.

The loader further generally is supported on a bracket attached to a pivot mechanism mounted on the upstanding support member of the frame. The pivot mechanism typically comprises a motor, such as a servomotor, stepper motor, etc., or can include a cylinder or other similar drive mechanism, connected to a pivot or drive rod to which the bracket for supporting the loader is attached. The pivot mechanism itself is typically mounted on a carriage or slide that is vertically moveable along one side of the upstanding support member of the support frame for moving the loader between a lowered, initial or rest position at which the stacks of cartons are received thereon, and a raised, second or transport position. The raising and lowering of the loader can be controlled via a drive motor, cylinder or similar drive mechanism mounted to the slide.

Once the loader is raised to its transport position, the pivot mechanism typically will be engaged so as to cause the loader, and thus the stack of cartons thereon, to be pivoted and reoriented approximately 90°. The loader could be pivoted a greater or lesser extent as needed to reorient the stack of cartons being held on the loader against a stack of previously loaded stack of cartons on the feeder conveyor. The feeder conveyor generally will include a series of spaced chains, belts or other drive elements, typically arranged in pairs with channels or passages defined therebetween. The loader is carried forwardly along a discharge path by the movement of the support frame, generally passing above the surface of the feeder conveyor, substantially parallel to the channels or passages defined between the conveying elements. As the loader approaches a previously loaded stack of cartons on the feeder conveyor, the forward motion the previously loaded cartons is detected by a sensor mounted to the frame, which signals the automatic carton magazine loading system to substantially slow or stop its forward movement of the loader along the feeder conveyor. Thereafter, the loader will be lowered as the clamp mechanism is released so that the support arms of the loader pass into and are received within the passages or channels of the feeder conveyor so that the stack of cartons is placed in a resting position on top of the conveying elements of the feeder conveyor. The loader is then moved rearwardly along the feeder conveyor back to its initial, loading position, with the arms of the loader passing along the channels or passages of the feeder conveyor so as to avoid interfering with the stacks of cartons as they placed on the feeder conveyor.

Various features, objects and advantages of the present invention will become apparent to those skilled in the art upon review of the following detailed description when taken in conjunction with the accompanying drawings.

DETAILED DESCRIPTION OF THE INVENTION

Figure 1:
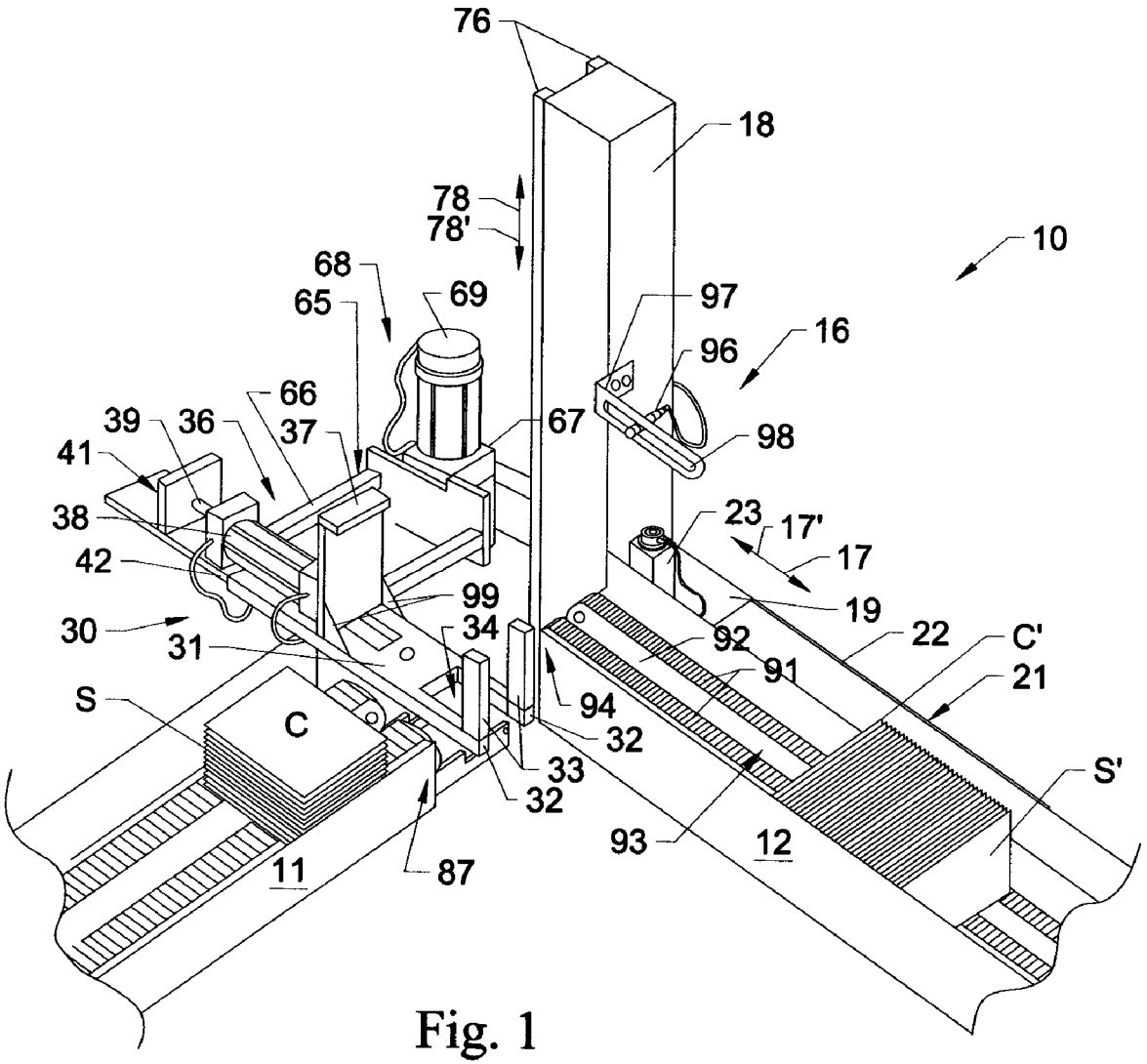
FIG. 1 is a perspective illustration of the automatic carton magazine loading system of the present invention.
Figure 2:
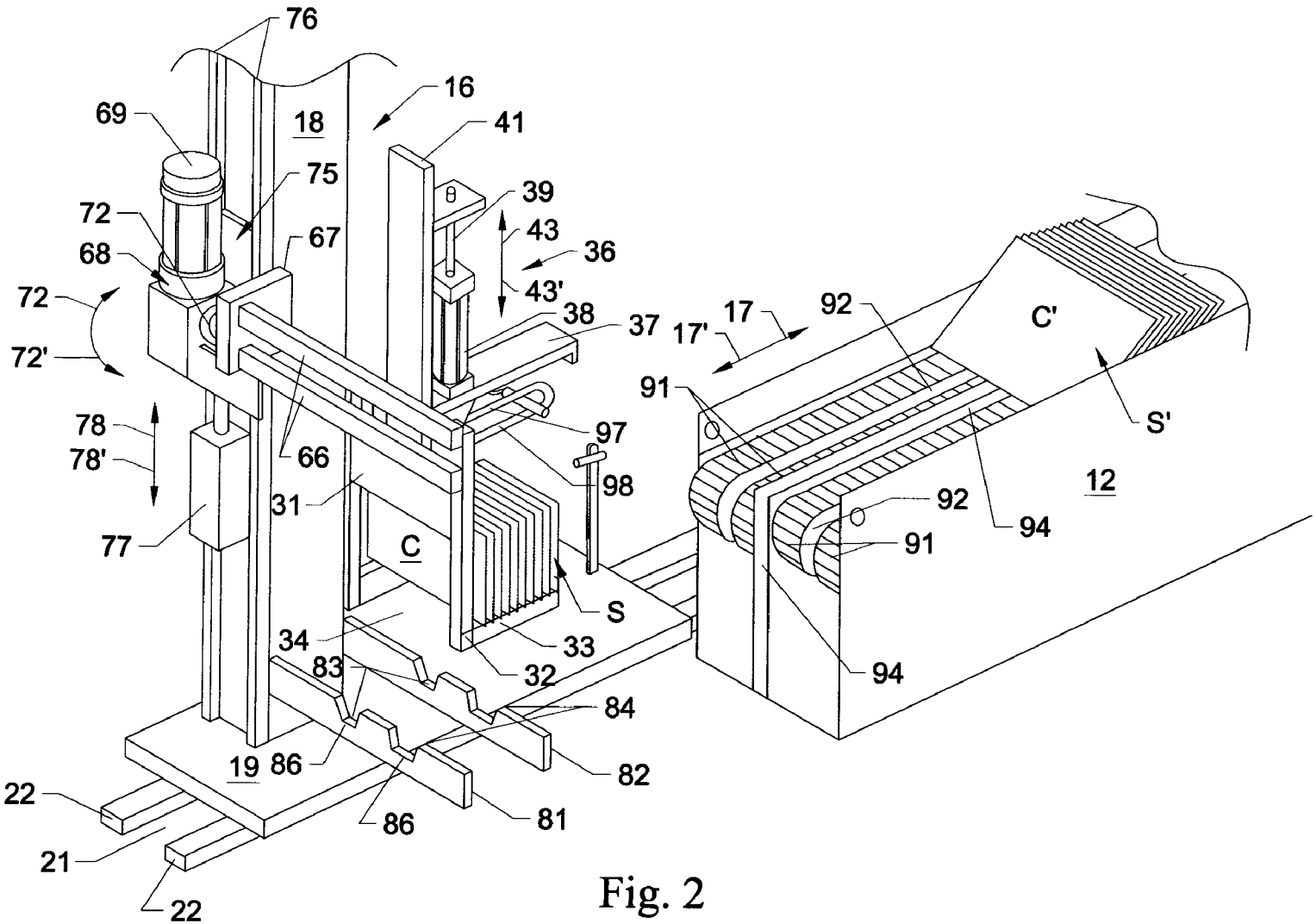
FIG. 2 is a perspective illustration of the automatic carton magazine loading system of FIG. 1 and generally illustrates the cartons being reoriented for stacking on the feeder conveyor.
Figure 3:
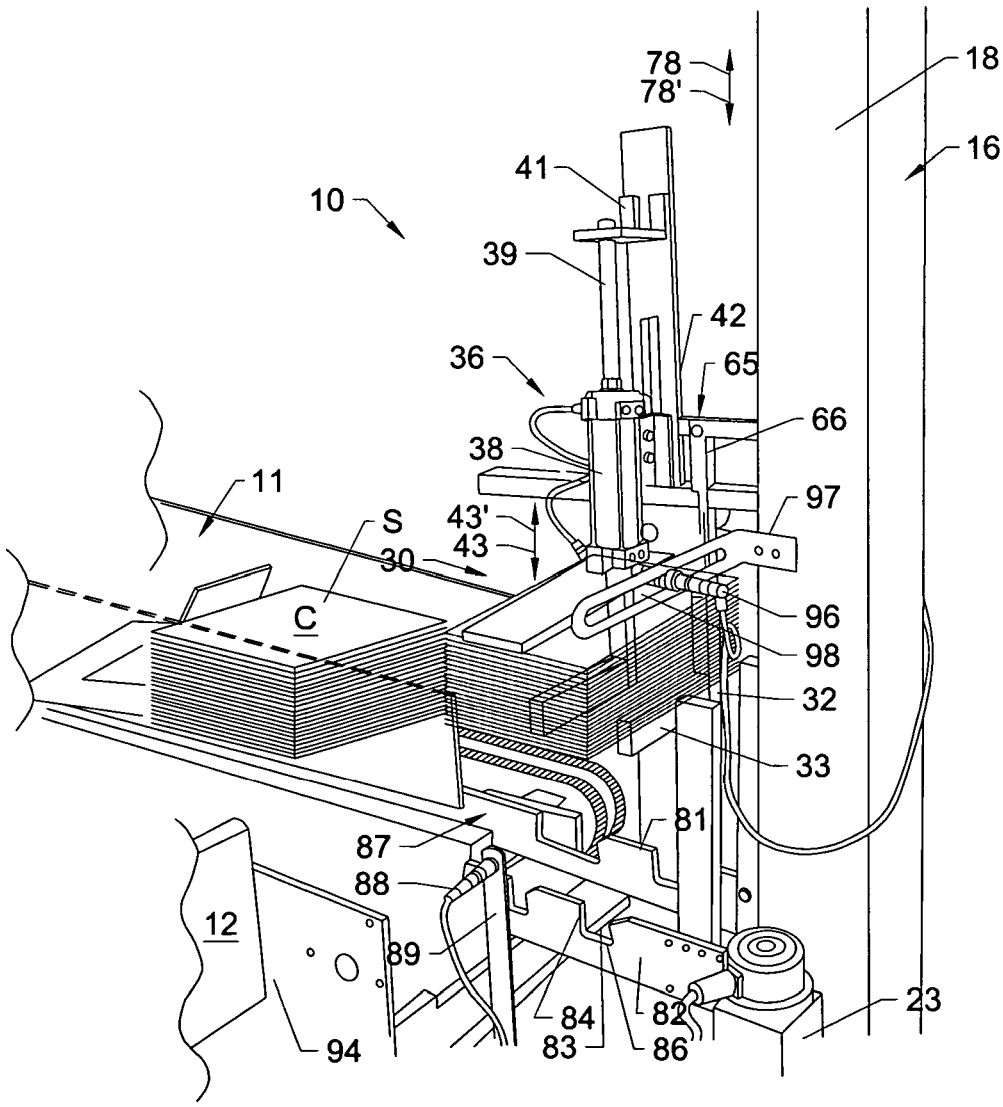
FIG. 3 is a perspective illustration of the operation of the loading of the automatic carton magazine loading system of the present invention.

Referring now to the drawings in greater detail in which like numerals indicate like parts throughout the several views, FIGS. 1-3 illustrate one example embodiment of the automatic carton magazine loading system 10 according to the principles of the present invention. The automatic carton magazine loading system 10 generally receives stacks S of cartons C in a substantially flat-lying, vertically stacked attitude from an automated stacker/collator or other source via an in-feed or loader conveyor 11, and reorients and transfers the stacks of cartons to a feeder conveyor 12 for feeding into a magazine or mass feeder for a product packaging machine (not shown) to maintain a substantially consistent supply of cartons for feeding into the packaging machine. It will be understood by those skilled in the art that while the present invention generally is shown for the loading of cartons onto a feeder conveyor for a packaging machine, other varying configurations or type articles or products can be similarly received, reoriented and loaded or stacked for packaging or other applications, and thus the present invention is not limited solely to the loading of stacks of flat cartons for feeding into the product packaging machine.

As generally illustrated in FIGS. 1-3, the automatic carton magazine loading system 10 generally includes a moveable frame 16 mounted between the conveyor 11 and feeder conveyor 12 and moveable in the direction of arrows 17 and 17' substantially parallel to the feeder conveyor 12. The frame generally includes an upstanding vertical support member or stanchion 18 that is mounted on a carriage or drive plate 19 (FIG. 2) that in turn is moveably mounted on and rides along a guide track 21. The guide track typically can include one or more guide rails 22 along which the carriage 19 is seated and rides in the direction of arrows 17 and 17'. A drive motor 23 is mounted on the carriage as indicated in FIGS. 1 and 3 and generally engages the guide track so as to pull or drive the carrier plate and thus the frame 16 along a transport and discharge path of travel (indicated by arrows 17/17') along the guide track and adjacent the feeder conveyor 12 for depositing the stacks S of cartons C thereon.

A loader 30 is moveably mounted on the vertical support member 18 of the frame 16 for receiving and reorienting the stacks of cartons being fed from the loader conveyor 11. In a first embodiment shown in FIGS. 1 and 3, the loader generally includes a base or support plate 31 that can have a substantially "H" or U-shaped configuration with spaced legs 32 projecting from a forward or downstream end thereof, initially positioned in a substantially flat, horizontally oriented attitude for receiving the stacks S of cartons C therein in a vertically stacked arrangement as indicated in FIGS. 1 and 3. Support members or arms 33 are mounted to and project upwardly from the legs 32 or downstream end of the base plate 31, with the support arms or members 33 generally being substantially spaced apart and extending at a substantially 90° angle therefrom, although the arms also can be mounted at other, varying angles as needed to hold varying configurations of products or cartons. In a first embodiment of the loader, such as illustrated in FIGS. 1-3, the support arms or members 33 are each attached to the spaced legs 32 of the base plate 31, defining a gap 34 therebetween. The base plate and support members generally are constructed from a high strength or resilient material having a substantially non-stick surface, such as aluminum or other metals or various synthetic or plastic materials.

The loader 30 further generally will include a clamp mechanism 36, which can be mounted adjacent the base plate 31 of the loader 30. The clamp mechanism 31 as shown in FIGS. 1-3 can include a clamp plate 37 positioned at an upstream or first end of the base plate 31 and oriented in a substantially opposing relationship to the support members 33. A drive mechanism, such as a drive cylinder 38 generally will be mounted to the clamp plate 36 and will include a cylinder rod 39 attached to a supporting bracket or plate 41 that itself typically is attached to the base plate 31 of the loader at the upstream end 42 thereof as indicated in FIG. 1. The cylinder 38 will move the clamp plate 37 in the direction of arrows 43 and 43' toward and away from stacks S of cartons C received on the base plate 31 to urge and capture the stacks of cartons against the support members 33 so that the cartons are held and supported against movement during reorientation and transport to the feeder conveyor.

Figure 4:
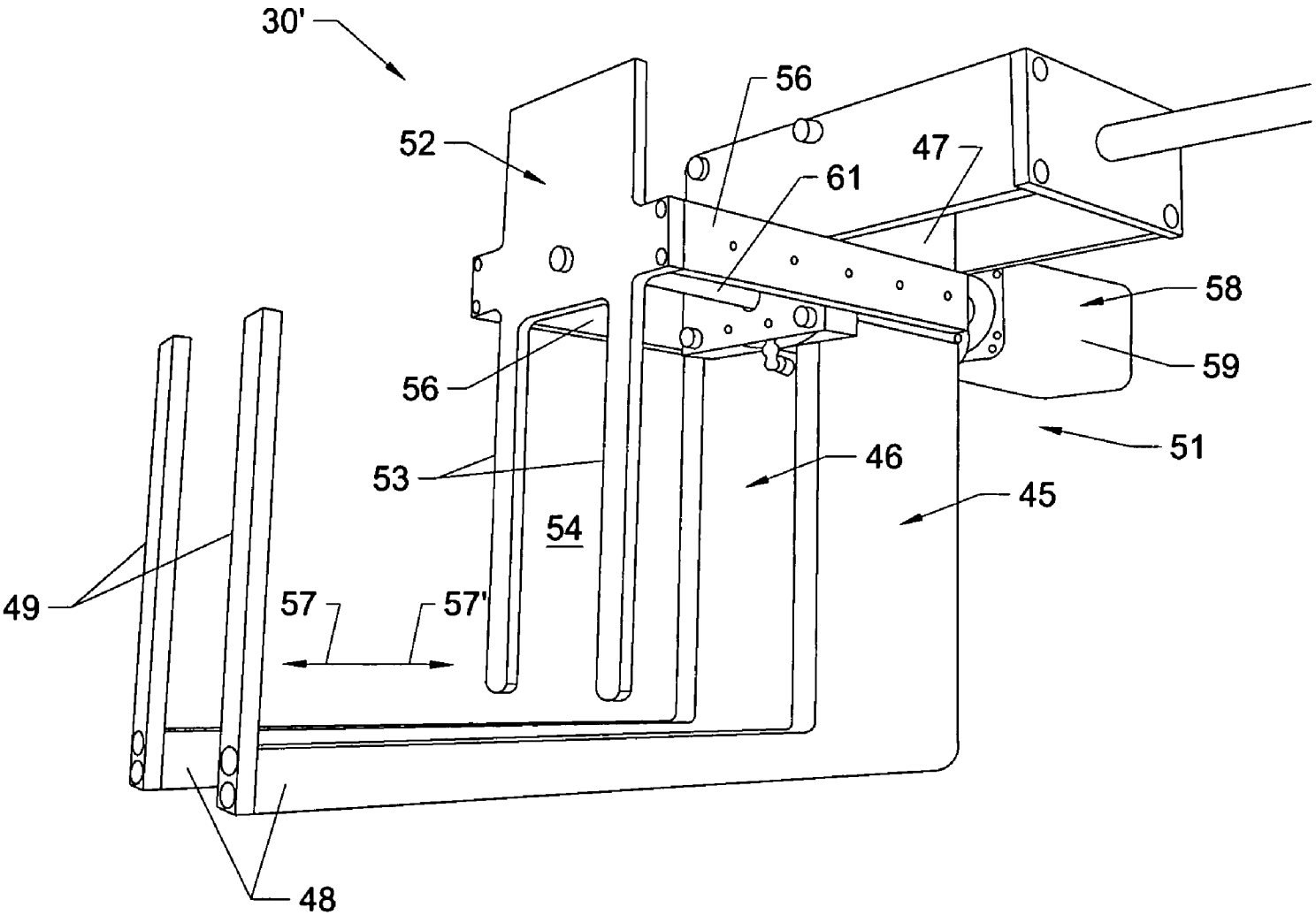
FIG. 4 is a perspective view of an alternative embodiment of the loader of FIGS. 1-3.

In an alternative embodiment of the loader as illustrated in FIG. 4, the loader 30' can include a pair of substantially L-shaped support plates 45 and 46, each having a first, raised or upper end 47 and a second, forwardly extended distal end 48. Arms or support members 49 are mounted to the second or distal ends 48 of each of the support plates 45 and 46 and are projecting upwardly in substantially a 90° angle, although greater or lesser mounting angles also can be used as desired. A clamp mechanism 51 is mounted adjacent the first or upper ends of the support plates and generally includes a substantially H-shaped clamp plate 52 having downwardly projecting legs or spaced apart legs 53 of a gap 54 therebetween. Support arms or guides 56 are attached to the sides of the clamp plate 52 and extend rearwardly therefrom along the outer side edges of the support plates 45 and 46. The guides 56 help guide and prevent twisting or rotational movement of the clamp plate as it is moved forwardly and rearwardly toward and away from the arms 49 of support plates 45 and 46 in the direction of arrows 57 and 57' to clamp and thereafter release a stack of cartons from engagement against the arms 49. A drive mechanism 58 mounted is adjacent the rear edges of the support plates 45 and 46 at their upper ends 47, and typically includes a hydraulic, pneumatic cylinder 59 that extends and retracts a cylinder rod 61 attached to the clamp plate 52 for controlling the movement of the clamp plate in the direction of arrows 57 and 57'. It will also be understood by those skilled in the art that while the drive mechanism 58 is shown as a cylinder 59, other mechanisms such as a drive motor with a travel screw, linear actuator or other similar drive systems also can be used to control a clamping/unclamping operation of the loader.

As illustrated in FIGS. 1-3, the loader 30 generally will be mounted on a support bracket 65 that holds the loader in a position spaced from the vertical support member 18 of the frame 16. The bracket 65 supports the loader during pivoting and movement of the loader in the direction of arrows 17 and 17' along the feeder conveyor 12. The support bracket 65 can include a substantially solid plate, or can include a pair of spaced arms or plates 66, as indicated in FIGS. 1 and 2, attached to a pivot plate 67 that itself is attached to a pivot mechanism 68. The pivot mechanism 68, generally illustrated in FIGS. 1 and 2, typically will include a drive motor 69 attached to a gear box 71, or similar transmission device for driving or causing rotation of a pivot rod 72 (FIG. 2) to which the pivot plate 67 is attached. The drive motor rotates the drive rod, causing the pivoting movement of the loader 30 in the direction of arrows 72 and 72'. When pivoted, the loader, and thus the stack of cartons captured thereon, will be reoriented approximately 80°-100° and typically about 90°. However, it is possible that the stack of cartons could be pivoted to an orientation less than or greater than a rotation of about 90° as needed to realign the stack of cartons for loading/stacking against a previously loaded stack of cartons S' (FIG. 2) on the feeder conveyor 12.

Figure 5B:
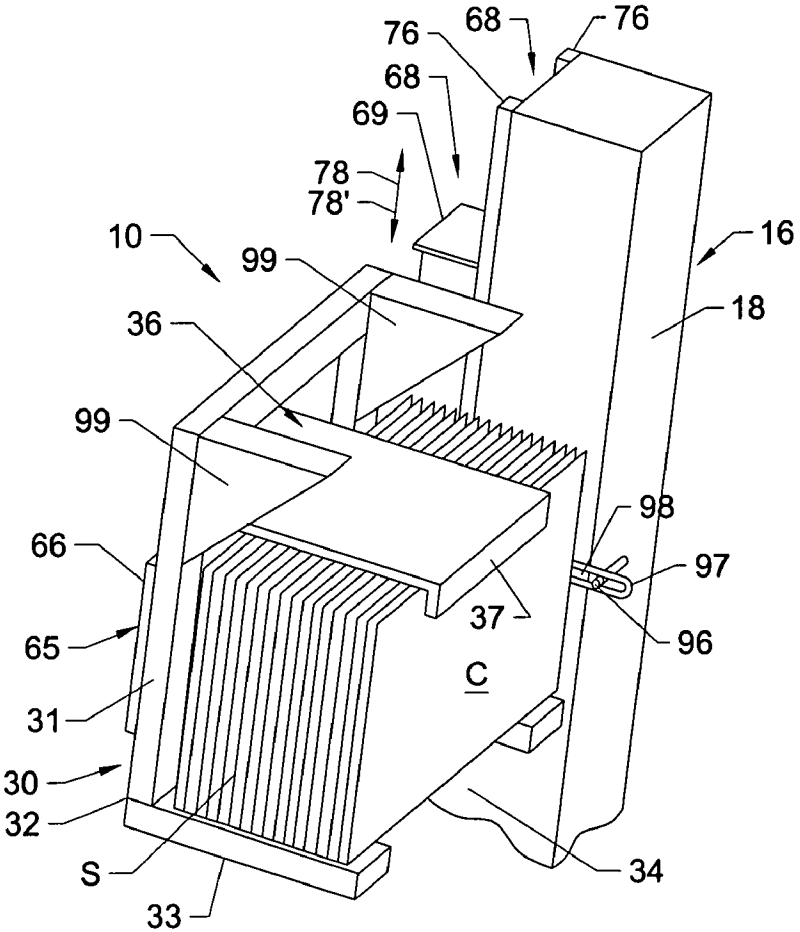
FIGS. 5A-5C are sequential views illustrating the loading, reorienting, and discharge of a stack of cartons using the automatic carton magazine loading system of the present invention.
Figure 5A:
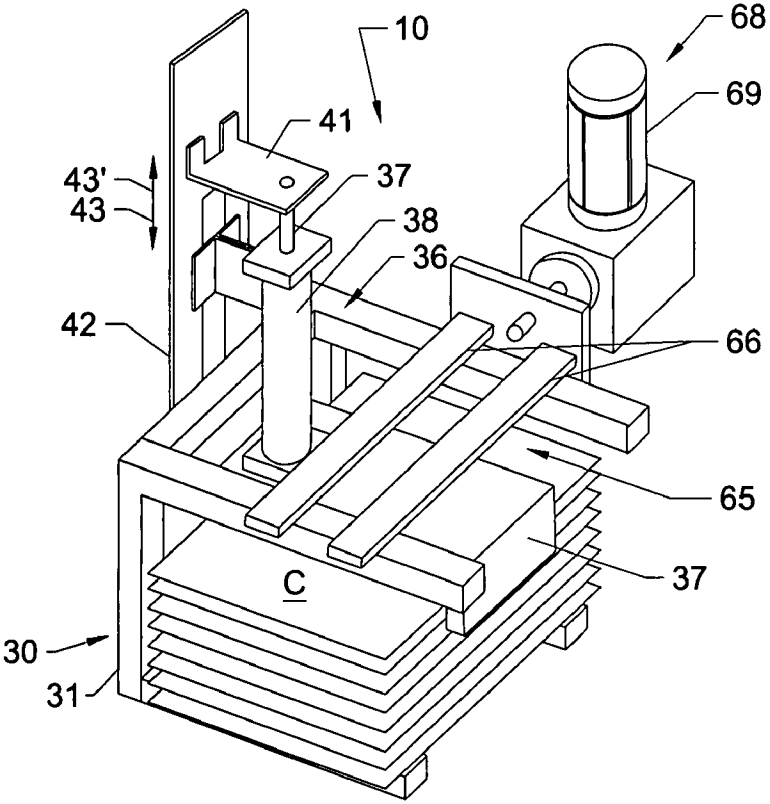

As further illustrated in FIG. 2, the pivot mechanism 68 further itself is generally mounted on a support or carrier plate 75 that rides along the guide tracks 76 mounted to a rear side of the upstanding vertical support member 18 of the frame 16. A drive motor 77 typically is mounted along the guide track for controlling the vertical movement of the carrier plate with the pivot mechanism mounted thereon along the guide tracks 76 in the direction of arrows 78 and 78' for raising and lowering the loader 30 between an initial, rest or loading position as illustrated in FIGS. 1 and 5A, a raised transport position as generally illustrated in FIGS. 2, 3, and 5B, and a discharge position at which the cartons are discharged against the previously loaded stack S' of cartons already loaded on the feeder conveyor.

As indicated in FIGS. 2 and 3, when in its lowered, initial or rest position for loading, the loader 30 typically will engage and rest upon a pair of spaced guides 81 and 82. Each of the guides 81 and 82 generally includes a pair of guide slots 83, or recesses that taper inwardly from an open upper end 84 to a lower or bottom end 86 so as to help guide the legs of the base plate into a rest position on the guides 81 and 82 to help ensure substantially consistent positioning of the loader for loading of the stacks of cartons thereon. In its loading position, the loader is generally positioned immediately adjacent the downstream or discharge end 87 (FIG. 1) of the loader/conveyor 11 so that as the stacks S of cartons C are discharged from the loader conveyor, they are received directly on the loader as indicated in FIG. 1.

As indicated in FIGS. 1 and 3, a loading sensor 88 generally is mounted on an upstanding support 89 mounted on the carriage 19 of the frame 16. The loading sensor typically can include a photo cell, proximity sensor, or other similar detector that detects when a stack of cartons has been loaded onto the loader. The loading sensor will signal the control system of the automatic carton magazine loading system of the present invention to begin a transfer and loading operation. In response to this signal, the loader will be raised vertically to its transport position, such as indicated in FIG. 3, and thereafter will be reoriented, such as indicated in FIGS. 2 and 5B for transport along the feeder conveyor 12 for discharge of the stack of cartons S against the previously loaded stack S' of cartons C already on the feeder conveyor 12 as indicated in FIG. 5C.

Figure 5C:
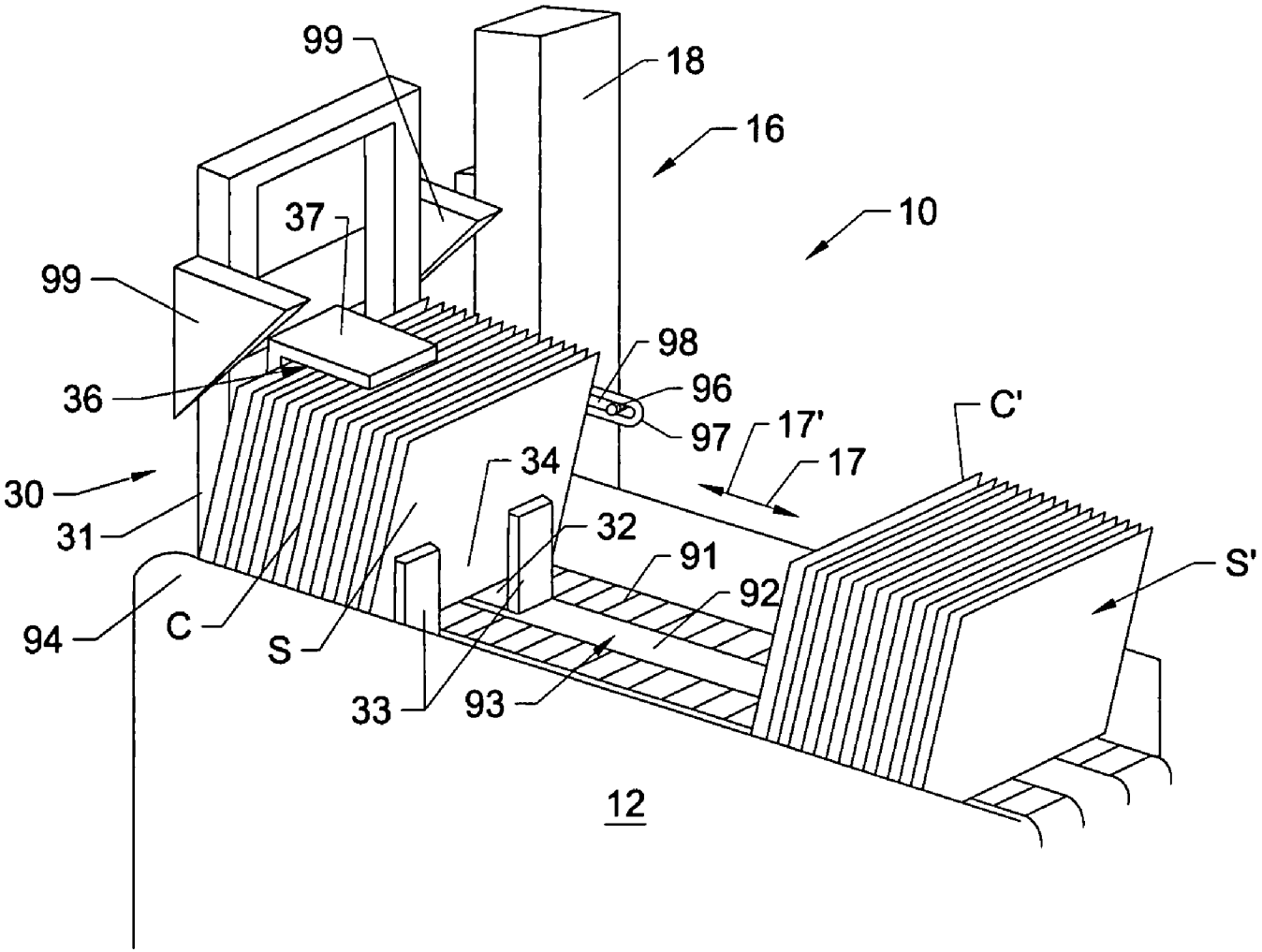

As illustrated in FIGS. 2 and 5C, the feeder conveyor 12 generally will include a series of conveying elements 91, typically arranged in spaced pairs and defining gaps, passages or channels 92 therebetween. The conveyor elements can include conveyor chains, belts or other, similar known conveying elements that will extend in a substantially elliptical path in the direction of arrows 17 and 17' so as to define a supporting surface 93 on which the stacks of cartons are deposited for conveying the stacks of cartons to the feeder of the packaging machine (not shown). The feeder conveyor further includes an upstream or proximal end 94 that is positioned adjacent and slightly downstream from the loader.

A stack sensor 96 further is mounted to the frame 16 adjacent the downstream end thereof to detect the proximity of the previously loaded stack S' of cartons on the feeder conveyor. The stack sensor 96 can include a proximity sensor, photo cell or other, similar detector or sensor that can detect the presence of the rearmost carton C' of previously loaded cartons on the feeder conveyor. The stack sensor generally will be mounted on a substantially U-shaped support 97, being mounted in a guide channel 98 extending through the support 97 so that the position of the stack sensor 96 can be adjusted as needed, depending upon the size or thickness of the stack of cartons on the loader so as to provide sufficient lead time for detection of the rearmost carton in the previously loaded stack of cartons on the feeder conveyor to ensure that the new stacks can be loaded thereagainst without damage and without slipping or falling rearwardly away from the previously loaded stacks or otherwise causing a misfeed or mis-stacking of the cartons.

In addition, as indicated in FIGS. 1 and 5B-5C, the loader further can include angled guides or plates 99 mounted to the base plate of the loader. Each of these guides can include an angled forward facing surface against which the rearmost cartons generally will be engaged. The guides typically will be made from nonstick materials such as "Delrin" or similar material. As the cartons are moved and released against the previously loaded stack S' of cartons on the feeder conveyor, the engagement of the rearmost cartons of the stack S of cartons on the loader against the angled forward surfaces of the guides 99 generally will cause the stack to be urged or angled forwardly so as to naturally fit and lean against the previously loaded stack of cartons on the feeder conveyor.

In operation of the automatic carton magazine loading system of the present invention, as indicated in FIGS. 1-3, and 5A-5C, stacks S of cartons C are transported along the loader conveyor 11 and are discharged from the discharge end 87 thereof onto the base portion of the loader 30 as indicated in FIG. 1. Once the loading sensor 88 senses that a stack of cartons has been received on the loader, it signals the control system for the automatic carton magazine loading system 10, which activates the drive motor 77 (FIG. 2) so as to cause the movement of the carrier plate 75 and thus the loader 30 upwardly in the direction of arrow 78 along the upstanding vertical support member 18 of the frame 16. The loader is raised vertically to a transport position as indicated in FIGS. 3 and 5B. Thereafter, the pivot mechanism 67 is actuated, causing the loader to be pivoted approximately 80° to 100°, typically about 90°, so as to reorient the stack S of cartons S from a substantially flat horizontal lying orientation (FIGS. 1, 3 and 5A) to a substantially vertically oriented attitude as indicated in FIGS. 2 and 5B.

Once the loader has been moved to its pivoted and raised transport position, the frame 16 carrying the loader 30 is then moved in the direction of arrow 17 along the feeder conveyor 12 to a discharge position for discharging the stack of cartons contained on the loader against a previously loaded stack S' of cartons on the feeder conveyor as illustrated in FIGS. 2 and 5C. As the loader approaches the previously loaded stack S' of cartons on the feeder conveyor, the stack sensor 96 detects the presence of the rearmost carton(s) C' of the stack S' and sends a control signal to stop further forward movement of the carriage, frame and loader along the feeder conveyor. The clamp mechanism is then disengaged with the raising and/or release of the clamp plate from engagement with the cartons, while at substantially the same time, the loader is lowered with respect to the feeder conveyor. The loader is lowered such that its arms are received and pass into the channels of the passages 92 defined between the conveying elements 91 of the feeder conveyor. The arms of the loader are lowered below the supporting surface 93 of the feeder conveyor to a height sufficient to deposit the stack of cartons on the supporting surface defined by the conveyor elements, while the arms are lowered below the level of the conveyor elements so as to be substantially removed from engagement with the cartons.

Thereafter, the frame and loader of the automatic carton magazine loading system are moved rearwardly in the direction of arrow 17', with the arms of the loader passing along the passages or channels 92 of the feeder conveyor until the loader is returned to its transport position as indicated in FIG. 2. The loader then is pivoted or otherwise reoriented and lowered back to its initial loading position such as indicated in FIG. 1 for receiving a next stack of cartons from the loading conveyor.

It will be understood by those skilled in the art that while the present invention has been discussed above with reference to particular embodiments, various modifications, additions and changes can be made to the present invention without departing from the spirit and scope of the present invention.

What is claimed:

1. A system for loading stacks of articles on a feeder, comprising:

a frame;

a vertically moveable loader rotatably mounted to said frame and including at least one article support member;

said loader moveable from a first position for receiving the stacks of articles, and a second position wherein the stacks of articles are reoriented for placement of the stacks of articles on the feeder;

a pivot assembly mounted to said frame and including a drive mechanism coupled to said loader for pivoting said loader between its first and second positions;

a carriage supporting said frame and adapted to move said loader to a position along the feeder for discharge of the stacks of articles to the feeder;

a stack sensor mounted adjacent said position for discharge of the stacks of articles from said loader to a support surface for the feeder for detecting previously loaded cartons on the feeder;

a control system in communication with said stack sensor; and a feeder conveyor on which the stacks of articles are received from said loader, said feeder conveyor comprising a series of spaced conveyor elements defining a series of channels therebetween, and wherein said loader comprises a pair of support arms adapted to be received and move along said channels for depositing a stack of articles carried by said loader adjacent a previously loaded stack of articles on said feeder conveyor;

wherein in response to the detection of the previously loaded cartons on the feeder by said stack sensor, said loader is lowered with respect to the feeder and movement of said carriage along the feeder is controlled for controlling the discharge of the stacks of articles to the feeder and for withdrawal of said loader from the discharged stacks of articles.

2. The system of claim 1 and wherein said drive mechanism of said pivot assembly comprises a motor.

3. The system of claim 1 and wherein said drive mechanism of said pivot assembly comprises a pneumatic or hydraulic cylinder.

4. The system of claim 1 and further comprising a clamp assembly mounted to a support for said loader and including a clamp moveable into engagement with the stack of articles for holding the stack of articles on said loader.

5. The system of claim 4 and wherein said clamp assembly further comprises a cylinder for moving said clamp toward and away from engagement with the stack of cartons on said loader.

6. A system for loading stacks of articles on a feeder, comprising:

a frame;

a vertically moveable loader rotatably mounted to said frame and including at least one article support member, a pair of spaced support members mounted to a support frame that is connected to said pivot assembly drive mechanism, and a clamp moveable into engagement with a stack of articles received on said support members for holding the stack of articles against said support members as said loader is pivoted from its first to its second position;

said loader moveable from a first position for receiving the stacks of articles, and a second position wherein the stacks of articles are reoriented for placement of the stacks of articles on the feeder;

a pivot assembly mounted to said frame and including a drive mechanism coupled to said loader for pivoting said loader between its first and second positions;

a carriage supporting said frame and adapted to move said loader to a position along the feeder for discharge of the stacks of articles to the feeder;

a stack sensor mounted adjacent said position for discharge of the stacks of articles from said loader to a support surface for the feeder for detecting previously loaded cartons on the feeder;

a control system in communication with said stack sensor; and a feeder conveyor having a series of spaced conveyor elements, wherein said support arms are spaced from each other and are dimensioned so as to pass between said spaced conveyor elements of said feeder conveyor as the articles are discharged onto the feeder;

wherein in response to the detection of the previously loaded cartons on the feeder by said stack sensor, said loader is lowered with respect to the feeder and movement of said carriage along the feeder is controlled for controlling the discharge of the stacks of articles to the feeder and for withdrawal of said loader from the discharged stacks of articles.

7. A method of loading stacks of cartons on a feeder, comprising:

moving a stack of cartons along a first path;

receiving the stack of cartons on a loader;

reorienting the loader with the stack of cartons thereon so as to realign the stack of cartons for stacking on the feeder;

moving the loader along a second path along a feeder conveyor toward a series of previously loaded cartons on the feeder conveyor;

as the loader approaches the previously loaded cartons, sensing the loader approaching the previously loaded cartons and in response, stopping the movement of the loader along the second path and releasing the cartons from clamping engagement by the loader;

moving spaced support members of the loader on which the cartons are received downwardly between a series of spaced conveyor elements of the feeder conveyor to lower the loader below a supporting surface of the feeder conveyor so that the stack of cartons is deposited onto the conveyor elements as the stack of cartons is deposited onto the supporting surface of the feeder conveyor and urged against the previously loaded cartons; and returning and reorienting the loader to a loading position.

8. The method of claim 7 and further comprising clamping the stack of cartons on the loader after the stack of cartons is received on the loader.

9. The method of claim 7 and wherein reorienting the loader comprises raising the loader to a level approximately aligned with the support surface of the feeder conveyor, and pivoting the loader to rotate the stack of cartons.

10. The method of claim 9 wherein pivoting the loader comprises rotating the loader and stack of cartons between approximately 80° and 110°.

11. The method of claim 7 and wherein moving the loader along the second path comprises moving a carriage on which a support frame for the loader is mounted along a guide track.

12. The method of claim 7 and further comprising moving the loader rearwardly along the feeder conveyor with its support members received and passing between the conveyor elements to return the loader to an initial position.

* * * * *